US009937607B2

(12) United States Patent
Helstrom et al.

(10) Patent No.: US 9,937,607 B2
(45) Date of Patent: Apr. 10, 2018

(54) FASTENER REMOVAL SOCKET

(71) Applicant: Snap-on Incorporated, Kenosha, WI (US)

(72) Inventors: Joshua M Helstrom, Riverside, CA (US); Matthew D Patterson, Chino Hills, CA (US)

(73) Assignee: Snap-on Incorporated, Kenosha, WI (US)

( * ) Notice: Subject to any disclaimer, the term of this patent is extended or adjusted under 35 U.S.C. 154(b) by 582 days.

(21) Appl. No.: 14/283,611

(22) Filed: May 21, 2014

(65) Prior Publication Data

US 2015/0336251 A1 Nov. 26, 2015

(51) Int. Cl.

| | |
|---|---|
| ***B25B 13/50*** | (2006.01) |
| ***B25B 13/00*** | (2006.01) |
| ***B25B 27/18*** | (2006.01) |
| ***B25B 13/06*** | (2006.01) |

(52) U.S. Cl.

CPC ..... *B25B 27/18* (2013.01); *B25B 13/065* (2013.01); *B25B 13/50* (2013.01); *B25B 13/5016* (2013.01)

(58) Field of Classification Search

CPC ..... B25B 27/18; B25B 13/065; B25B 13/50; B25B 13/5016

USPC ..... 408/203.5; 81/124.2, 53.2

See application file for complete search history.

(56) References Cited

U.S. PATENT DOCUMENTS

| | | | | |
|---|---|---|---|---|
| 151,635 A | | 6/1874 | Uhlinger | |
| 410,780 A | | 9/1889 | Cahn | |
| 906,040 A | | 12/1908 | Lucas | |
| 1,032,492 A | | 7/1912 | Mueller | |
| 1,155,662 A | | 10/1915 | Kleinsteuber | |
| 1,321,776 A | * | 11/1919 | Stepanian | B25B 13/48 81/120 |
| 1,324,042 A | * | 12/1919 | Gay | B25B 13/065 81/121.1 |
| 1,384,417 A | | 7/1921 | Weichhart | |
| 1,424,392 A | * | 8/1922 | Baker | B23C 5/00 407/47 |
| 1,425,359 A | | 8/1922 | Barry | |

(Continued)

FOREIGN PATENT DOCUMENTS

| | | |
|---|---|---|
| DE | 202004013291 | 11/2004 |
| EP | 2399534 | 6/2010 |

(Continued)

OTHER PUBLICATIONS

Chinese Office Action dated Aug. 30, 2016; 11 pages.

(Continued)

*Primary Examiner* — Bryan R Muller

(74) *Attorney, Agent, or Firm* — Seyfarth Shaw LLP

(57) ABSTRACT

A tool, such as, a socket, that is adapted to remove a stripped or otherwise difficult to remove fastener. The socket includes a body having first and second ends, a first axial bore in the first end adapted to receive the stripped or cylindrical fastener head, and one or more cutting channels in the body between the first and second ends forming internal cutting edges adapted to engage the stripped or cylindrical fastener head. The one or more cutting apertures may have an elongated diamond-like shape and extend a portion of the way around the body and toward the second end.

17 Claims, 3 Drawing Sheets

(56) References Cited

U.S. PATENT DOCUMENTS

| | | | | |
|---|---|---|---|---|
| 1,590,200 | A * | 6/1926 | McGuckin | B25B 13/065 279/99 |
| 1,732,549 | A | 10/1929 | Armstrong | |
| 1,785,847 | A | 12/1930 | Valentine | |
| 2,239,548 | A * | 4/1941 | Butler | B25B 13/06 81/124.6 |
| 2,574,352 | A | 11/1951 | Senter | |
| 2,601,798 | A | 7/1952 | Spence | |
| 3,161,090 | A | 12/1964 | McLellan | |
| 3,457,812 | A | 7/1969 | Wagner, Jr. | |
| 3,996,819 | A * | 12/1976 | King | B25B 13/065 81/124.6 |
| 4,270,418 | A | 6/1981 | Shephard | |
| 4,426,896 | A | 1/1984 | Kesselman | |
| 4,482,131 | A * | 11/1984 | Hamilton | B25C 11/00 254/18 |
| 5,551,320 | A | 9/1996 | Horobec et al. | |
| 5,690,004 | A | 11/1997 | Weber et al. | |
| 5,737,981 | A | 4/1998 | Hildebrand | |
| 5,743,158 | A | 4/1998 | Perkins | |
| 6,339,976 | B1 | 1/2002 | Jordan | |
| 6,546,778 | B2 | 4/2003 | Jordan | |
| 6,598,498 | B1 | 7/2003 | Pigford et al. | |
| 6,729,208 | B1 | 5/2004 | Chrzanowski | |
| 6,877,401 | B1 * | 4/2005 | Giltner | B25B 13/48 81/52 |
| 6,877,402 | B1 | 4/2005 | Pigford et al. | |
| 7,140,087 | B1 | 11/2006 | Giltner | |
| 7,152,508 | B2 | 12/2006 | McCalley et al. | |
| 7,325,468 | B1 | 2/2008 | Chen | |
| 7,594,455 | B2 | 9/2009 | Swanson et al. | |
| D649,848 | S | 12/2011 | Wegerich | |
| 8,607,670 | B2 | 12/2013 | Stawarski | |
| 8,978,523 | B2 * | 3/2015 | Stanfield | B25B 23/0085 81/124.2 |
| 9,314,906 | B2 * | 4/2016 | Nelson | B25B 13/06 |
| 2003/0056622 | A1 | 3/2003 | Jordan | |
| 2005/0150331 | A1 | 7/2005 | Horobec | |
| 2005/0183548 | A1 * | 8/2005 | Horobec | B25B 27/18 81/53.2 |
| 2009/0100971 | A1 * | 4/2009 | Swanson | B25B 27/18 81/53.2 |
| 2012/0210826 | A1 | 8/2012 | Stawarski | |
| 2013/0233133 | A1 * | 9/2013 | Nelson | B25B 13/06 81/121.1 |
| 2014/0026719 | A1 * | 1/2014 | Stanfield | B25B 23/0085 81/13 |

FOREIGN PATENT DOCUMENTS

| | | |
|---|---|---|
| GB | 2526937 A | 12/2015 |
| WO | 2011116474 | 9/2011 |

OTHER PUBLICATIONS

United Kingdom Intellectual Property Combined Search and Examination Report under Sections 17 and 18(3), dated Oct. 1, 2015; 6 pages.

State Intellectual Property Office of P.R. China, Second Office Action, dated Apr. 13, 2017; 6 pages.

Canadian Office Action for Application No. 2,889,831 dated May 4, 2017, 3 pages.

* cited by examiner

FASTENER REMOVAL SOCKET

FIELD

The present application relates to tools for removing fasteners and, in particular, to sockets for removing fasteners.

BACKGROUND

A variety of wrenches and tools are commonly used to apply torque to a workpiece, such as a threaded fastener, to remove the workpiece from engagement with a corresponding structure or device. The workpiece may have any number of different sizes and shapes. Accordingly, many tools include a driver which mates with one or more of different adapters, such as sockets, to engage and rotate the different-sized workpieces. However, a workpiece can become stripped or damaged by the tool, making it difficult to remove the workpiece.

One tool that can be used to remove a stripped or damaged fastener is disclosed in U.S. Pat. No. 5,737,981 to Hildebrand (the "'981 patent"). The '981 patent discloses a removal device that attaches to a ratchet wrench to remove a fastener in a counter-clockwise direction. The removal device of the '981 patent includes tapered, internal threading that engages the fastener to rotate the fastener to remove it. However, the removal device of the '981 patent tends to over travel on the fastener and contact a surface of the structure in which the fastener is installed. The fastener also tends to become lodged or stuck in the removal device of the '981 patent upon removal of the fastener from the structure.

SUMMARY

The present application relates to removal sockets, for example, sockets that may be used to remove stripped workpieces, such as fasteners. The socket may also be used to remove cylindrical fasteners, such as fasteners used in the aerospace industry. The socket is adapted to couple to a conventional ratchet wrench lug and may be used to remove fasteners that are stripped or otherwise difficult to remove with conventional sockets (such as, a conventional hexagonal socket). The socket includes internal angled, arcuate cutting channels that gradually narrow as they extend circumferentially around the socket and toward an end of the socket. The cutting channels grip a head of the fastener and may be used to apply torque to the fastener when the socket is rotated in a counter-clockwise direction.

In an embodiment, the tool is a socket including a body having first and second ends, a first axial bore in the first end adapted to receive a stripped or cylindrical fastener head, and one or more cutting channels in the body between the first and second ends forming internal cutting edges adapted to engage a stripped or cylindrical fastener head. The first axial bore may have a first diameter at the first end and taper to a second diameter smaller than the first diameter in the body.

Each cutting channel may have an elongated, diamond-like shape and extend at least a portion of the way around the body and toward the second end. Each cutting channel may include a first end portion proximal to the first end of the body having a first width, a second end portion, and a third portion between the first and second end portions. A width of the cutting channel may increase from the first width to a second width at the third portion, and decrease from the third portion to a third width at the second end portion as the cutting channel extends around the body and toward the second end of the body.

In another embodiment, a cutting channel of the socket may be formed by milling the cutting channel in the body between the first and second ends of the body; thereby forming internal cutting edges adapted to engage the stripped or cylindrical fastener head.

BRIEF DESCRIPTION OF THE DRAWINGS

Embodiments of devices and methods are illustrated in the figures of the accompanying drawings which are meant to be exemplary and not limiting, in which like references are intended to refer to like or corresponding parts, and in which.

DETAILED DESCRIPTION

Detailed embodiments of devices and methods are disclosed herein. However, it is to be understood that the disclosed embodiments are merely exemplary of the devices and methods, which may be embodied in various forms. Therefore, specific functional details disclosed herein are not to be interpreted as limiting, but merely as a basis for the claims and as a representative example for teaching one skilled in the art to variously employ the present disclosure.

The present application relates to tools adapted to engage and remove stripped or otherwise difficult to remove workpieces, such as fasteners. The tools include internal angled, arcuate cutting channels that gradually narrow as they extend circumferentially around the inner wall of the socket and toward an end of the socket. The cutting channels are adapted to grip a head of the fastener and may be used to apply torque to the fastener when the socket is rotated in a counter-clockwise direction.

Figure 1:
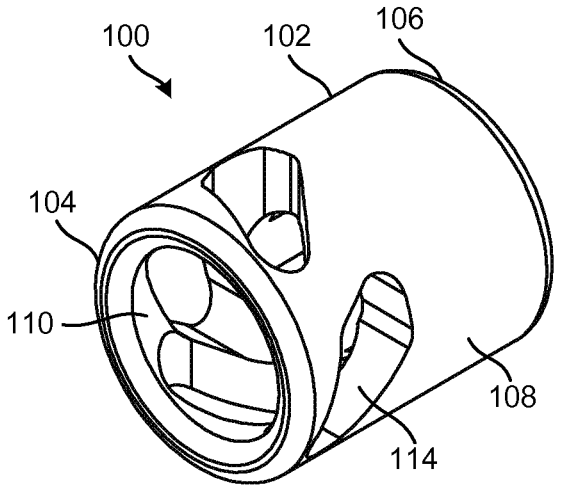
FIG. 1 is a perspective side view of a removal socket in accordance with an embodiment of the present application.
Figure 2:
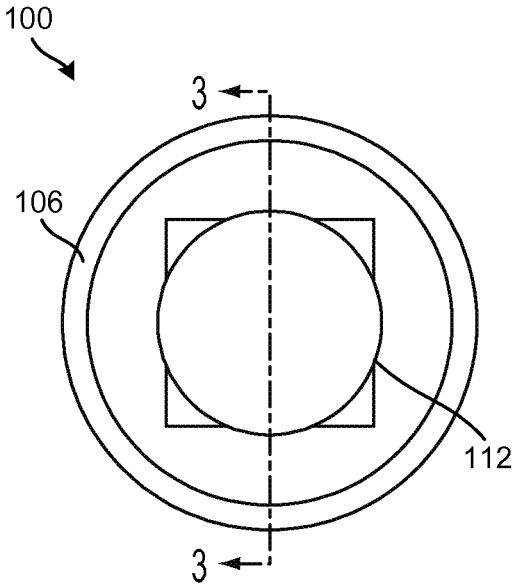
FIG. 2 is an end plan view of the removal socket in accordance with an embodiment of the present application.

FIGS. 1-4 illustrate an embodiment of a tool, such as a socket 100 adapted to mate with a drive lug of a wrench, such as a ratchet wrench, in a well-known manner. As illustrated, the socket 100 includes a body 102 having a first end 104, a second end 106, an outer surface 108, a first axial bore 110 in the first end 104, a second axial bore 112 (as illustrated in FIG. 2) in the second end 106, and one or more cutting channels 114 extending through the body 102 from the outer surface 108 toward the first axial bore 110.

Figure 3:
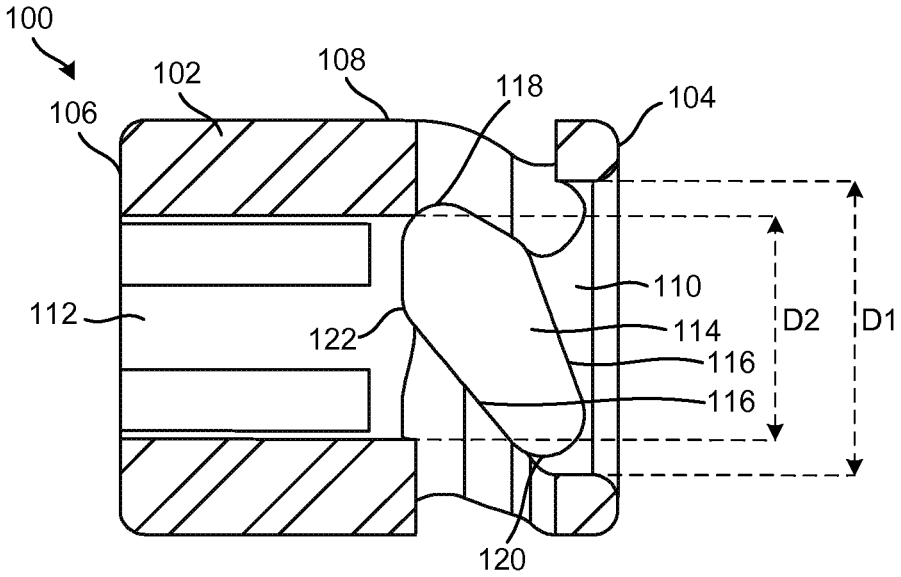
FIG. 3 is a cross-sectional plan view taken along line 3-3 of the removal socket in FIG. 2 in accordance with an embodiment of the present application.

Referring to FIG. 3, the first axial bore 110 in the first end 104 is adapted to receive a fastener head, such as a bolt head or nut. The first axial bore 110 may have a generally cylindrical cross-sectional shape axially extending at least partially through the body 102 from the first end 104 toward the second end 106 to a location between the first end 104 and the second end 106. The first axial bore 110 may also be tapered from a first diameter D1 proximal to the first end 104 to a second diameter D2, smaller than the first diameter D1, as the first axial bore 110 extends from the first end 104 in a direction of the second end 106 to the location between the first end 104 and the second end 106, thereby forming a generally frustroconical cross-sectional shape.

Figure 4:
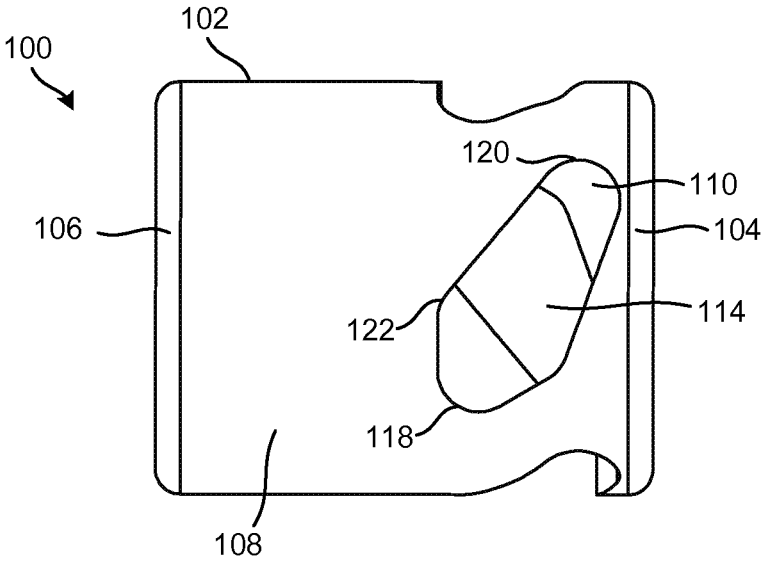
FIG. 4 is a side plan view of the removal socket in accordance with an embodiment of the present application.

Referring to FIGS. 3 and 4, the cutting channels 114 extend through the body 102 to the first axial bore 110. The cutting channels 114 may form internal, tapered, helixing cutting edges 116 in the body 102. These cutting edges 116 allow for the removal of a stripped fastener and/or cylindrical fasteners by cutting or "biting" into the fastener and gripping onto the fastener. For example, after engaging the fastener with the socket 100, torque may be applied to the fastener in a counter-clockwise direction using a tool, such as a ratchet wrench, to remove the fastener from a structure.

The cutting channels 114 may form a generally elongated, tapered diamond-like shape. For example, the cutting channels 114 may have a first end portion 118 a second end portion 120, and a third portion 122 between the first end portion 118 and the second end portion 120. The cutting channels 114 may increase in width from the first end portion 118 to the third portion 122, and decrease in width from the third portion to the second end portion 120. As illustrated in FIGS. 3 and 4, the second end portion 120 of the cutting channel 114 is closer to the first end 104 of the body 102, compared to the first end portion 118 of the cutting channel 114. Thus, the cutting channel 114 is angled and extends in a direction circumferentially around the body 102 toward the second end 106 of the body 102, and increases in width from the second end portion 120 to the third portion 122, and then decreases in width from the third portion 122 to the first end portion 118 as the cutting channel 114 extends around the body 102 toward the second end 106 to form the internal, tapered, helixing cutting edges 116.

Referring to FIG. 2, the second axial bore 112 may have a substantially square cross-sectional shape extending at least partially through the body 102 from the second end 106 toward the first end 104. The second axial bore 112 may be adapted to matingly engage a drive shaft or drive lug of a tool, for example, a hand tool, a socket wrench, a torque wrench, an impact driver, an impact wrench, and other tools, in a well-known manner. The squared cross-sectional shape may be, for example, about a ¼ inch square or other SAE or metric sizes. In yet other embodiments, the second axial bore 112 may be formed to have different cross-sectional shapes adapted to mate with different shaped receptacles of different tools, for example, the cross-sectional shape of the second axial bore 112 may be triangular, rectangular, pentagonal, hexagonal, heptagonal, octagonal, hex shaped or other shapes of the type.

Referring to FIGS. 1-4, in an embodiment, the socket 100 may have a length of about 0.6 inches and a diameter of about 0.5 inches. In this embodiment, referring to FIGS. 2 and 3, the first diameter D1 of the first axial bore 110 may be about 0.35 inches, the second diameter D2 of the first axial bore 110 may be about 0.27 inches, and the second axial bore 112 may be a ¼ in drive square and extend about 0.3 to about 0.4 inches into the body 100 from the second end 106.

Figure 5:
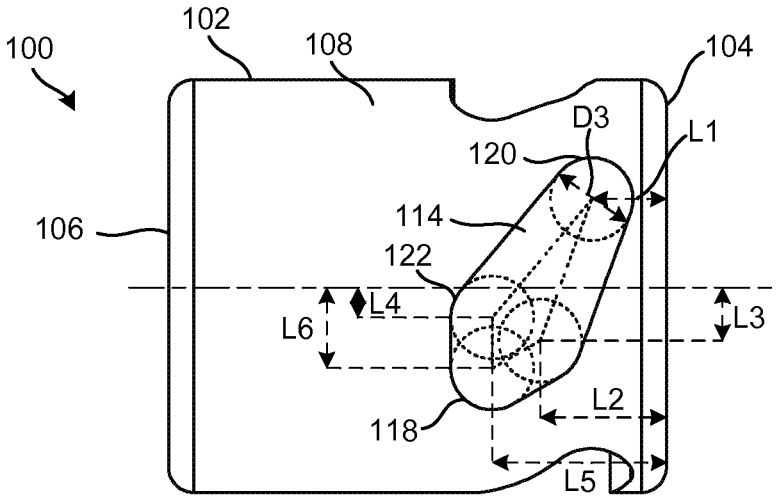
FIG. 5 is a side plan view of a removal socket illustrating dimensions in accordance with an embodiment of the present application.

Additionally, referring to FIG. 5, the socket 100 includes four cutting channels 114 in spaced relationship around the socket 100. The internal tapered helixing cutting edges formed by the cutting channels 114 may be created by performing a series of milling and/or machining operations on the outer surface 108 of the body 102. The geometry of the shapes cut into the body 102 facilitates the pitch and taper rate of the cutting edges. For example, in the embodiment where the socket 100 has the length of about 0.6 inches and the diameter of about 0.5 inches, the cutting channels 114 may be formed by milling the first end portion 118, the second end portion 120, and the third portion 122 in accordance with the dashed circular lines illustrated in FIG. 5.

In this embodiment, the second end portion 120 of the cutting channel 114 may have a diameter D3 of about 0.1 inches, and a central portion of the second end portion 120 that is spaced a length L1 of about 0.09 inches from the second end 106.

The third portion 122 of the cutting channel 114 may be formed my milling two areas (i.e., the two dashed circular lines). A central portion of the area proximal to the first end 104 may be spaced a length L2 of about 0.152 inches from the first end 104 and a length L3 of about 0.066 inches from a centerline of the socket 100. A central portion of the area distal to the first end 104 may be spaced a length L4 of about 0.038 inches from the centerline of the socket 100, and a length L5 of about 0.21 inches from the first end 104.

Similarly, the first end portion 118 may be formed my milling one area (i.e., the dashed circular lines), in which a central portion may be spaced the length L5 of about 0.21 inches from the first end 104 and a length L6 of about 0.099 inches from the centerline of the socket 100. A remainder of the area of the cutting aperture 114 may be removed by performing additional milling and/or machining operations.

The socket described above is described generally with respect to a specific socket; however, the sizes and dimensions, and number of cutting channels, of the various elements of the socket may be scaled up or down, modified, and/or adapted for a particular use with one or more different tools or fastener types. For example, the socket may be adapted to receive different fastener sizes known in the art. Similarly, the size of the first axial bore may be adapted to receive different sizes and types of drive shafts or drive lugs of socket and/or ratchet wrenches.

The tapered geometry of the cutting channels 114 described herein engage fasteners with less stress and fastener deformation than prior art removal type sockets. Additionally, the internal cutting edges 116 (for example, illustrated in FIG. 3) produced by the milling operations described above allow for the socket 100 to grip onto the fastener in a much shorter distance than as disclosed in the prior art. The design of the socket 100 prevents the socket 100 from traveling too far onto the fastener, resulting in an amount of the fastener extending out of the socket 100 after the fastener is removed to allow the fastener to thereafter be removed from the socket 100. This allows for the socket 100 to be used repeatedly and reliably. The design of the socket 100 is also more compact, and allows the socket 100 to be used in tight spaces effectively, even when the fasteners are densely grouped.

It should be appreciated that the geometry of the cutting channels of the sockets described herein may be applied to other types of tools for applying torque to fasteners. For example, a wrench or box wrench may include the geometries disclosed herein to allow the wrench or box wrench to remove stripped or otherwise difficult to remove fasteners. Similarly, other tools and/or fasteners may include the geometries disclosed herein. Moreover, while the present invention has been described as removing fasteners in a counter-clockwise direction, it is to be understood that the present invention can be configured to be used in clockwise direction as well.

Although the devices and methods have been described and illustrated in connection with certain embodiments, many variations and modifications should be evident to those skilled in the art and may be made without departing from the spirit and scope of the present disclosure. The present disclosure is thus not to be limited to the precise details of methodology or construction set forth above as such variations and modification are intended to be included within the scope of the present disclosure. Moreover, unless specifically stated any use of the terms first, second, etc. do not denote any order or importance, but rather the terms first, second, etc. are merely used to distinguish one element from another.

What is claimed is:

1. A tool for removing a fastener having a head, comprising:

a body having first and second ends and an exterior surface;

a first axial bore adapted to receive the head is disposed in the body and defines an interior surface, the interior surface has a first diameter disposed adjacent to the first end and a second diameter disposed within the body towards the second end, wherein the second diameter is less than the first diameter and the interior surface tapers from the first diameter to the second diameter; and a cutting channel disposed between the first and second diameters and extending through the body from the exterior surface to the interior surface, the cutting channel forms a cutting edge on the interior surface that is adapted to cut into and grip the head, wherein the cutting channel has a generally elongated diamond-like shape and a width and extends a portion of the way circumferentially around the interior surface towards the second end, wherein the cutting channel includes:

a first end portion proximate to the first end of the body and having a first width;

a second end portion having a second width and circumferentially offset with respect to the first end portion; and a third portion between the first and second end portions having a third width;

wherein the width of the cutting channel increases from the first width to the third width, and decreases from the third width to the second width as the cutting channel extends circumferentially around the body toward the second end of the body.

2. The tool of claim 1, further comprising a second axial bore disposed in the second end that is adapted to engage a drive lug of a wrench.

3. The tool of claim 2, wherein the second axial bore has a substantially square cross-sectional shape.

4. A tool for removing a fastener having a head, comprising:

a body having first and second ends, and an exterior surface;

a first axial bore adapted to receive the head is disposed in the body and defines an interior surface, the interior surface has a first diameter disposed adjacent to the first end and a second diameter disposed within the body towards the second end, wherein the second diameter is less than the first diameter and the interior surface tapers from the first diameter to the second diameter; and a cutting channel disposed between the first and second diameters and extending through the body from the exterior surface to the interior surface, the cutting channel forms a cutting edge on the interior surface that is adapted to cut into and grip the head, wherein the cutting channel has a generally elongated diamond-like shape with first and second end portions and extends a portion of the way circumferentially around the interior surface towards the second end of the body, and the first end portion is circumferentially offset with respect to the second end portion.

5. The tool of claim 4, wherein the cutting channel includes a third portion between the first and second end portions, and the first end portion is proximal to the first end of the body.

6. The tool of claim 5, wherein the cutting channel has a first width at the first end portion and increases to a third width at the third portion as the cutting channel extends circumferentially around the body and towards the second end of the body.

7. The tool of claim 4, wherein the cutting channel has a third width at the third portion and decreases to a second width at the second end portion as the cutting channel extends circumferentially around the body and towards the second end of the body.

8. The tool of claim 4, wherein the first axial bore has a substantially circular cross-sectional shape.

9. The tool of claim 4, further comprising a second axial bore disposed in the second end that is adapted to engage a drive lug of a wrench.

10. The tool of claim 9, wherein the second axial bore has a substantially square cross-sectional shape.

11. A method for forming a tool adapted to remove a fastener having a head, comprising:

forming a first axial bore in a first end of the body, wherein the body has a second end opposite the first end, and the first axial bore is adapted to receive the head, wherein the first axial bore defines an interior surface of the body, the interior surface has a first diameter disposed adjacent to the first end and a second diameter disposed within the body towards the second end, wherein the second diameter is less than the first diameter and the interior surface tapers from the first diameter to the second diameter; and milling a cutting channel in the body between the first and second diameter and extending through the body from the exterior surface of the body to the interior surface, the cutting channel forms a cutting edge on the interior surface that is adapted to cut into and grip the head, wherein the cutting channel has a generally elongated diamond-like shape with first and second end portions and extends a portion of the way circumferentially around the interior surface towards the second end of the body and the first end portion is circumferentially offset with respect to the second end portion.

12. The method of claim 11, wherein the milling the cutting channel includes milling the first end portion proximal to the first end of the body, the second end portion, and a third portion between the first and second end portions.

13. The method of claim 12, wherein the milling the cutting channel includes milling the first end portion to a first width, and increasing the width to a third width at the third portion as the cutting aperture extends around the body and toward the second end of the body.

14. The method of claim 13, wherein the milling the cutting channel includes decreasing the width to a second width from the third portion to the second end portion as the cutting channel extends around the body and toward the second end of the body.

15. The method of claim 11, wherein forming the first axial bore includes forming the first axial bore having a substantially circular cross-sectional shape.

16. The method of claim 11, further comprising forming a second axial bore in the second end adapted to engage a drive lug of a wrench.

17. The method of claim 16, wherein forming the second axial bore includes forming the second axial bore having a substantially square cross-sectional shape.

* * * * *